United States Patent [19]

Scholle et al.

[11] Patent Number: 4,498,508

[45] Date of Patent: Feb. 12, 1985

[54] CONTAINER FILLER

[75] Inventors: William R. Scholle, Corona Del Mar; William Lloyd-Davies, South Laguna, both of Calif.

[73] Assignee: Scholle Corporation, Irvine, Calif.

[21] Appl. No.: 464,112

[22] Filed: Feb. 4, 1983

[51] Int. Cl.[3] ..... B65B 31/02

[52] U.S. Cl. ..... 141/5; 141/51; 141/92; 141/372; 53/88; 53/109; 99/474; 422/219; 426/399

[58] Field of Search ..... 99/474; 422/219; 53/88, 53/109, 426; 426/399, 400, 401; 141/1-12, 37-68, 85-92, 114, 69, 70, 100, 285-310, 372; 137/237, 238, 240; 98/36

[56] References Cited

U.S. PATENT DOCUMENTS 3,977,445 8/1976 White ..... 141/5

4,458,734 7/1984 Scholle et al. ..... 141/92

*Primary Examiner*—Houston S. Bell, Jr.

*Attorney, Agent, or Firm*—Knobbe, Martens, Olson & Bear

[57] ABSTRACT

A device for filling a container through a spout extending from the container includes a sterile chamber having a wall opening therethrough for inserting the spout into the chamber. A cover inside the chamber is positioned over a base plate which encloses the wall opening to prevent the escape of sterile gas from the chamber when the spout is being inserted into and removed from the wall opening. A pair of jaws fit around the spout when the spout is in the opening to hold the spout in position for filling and to prevent contamination of the sterile chamber during the filling operation.

11 Claims, 9 Drawing Figures

Fig. 1
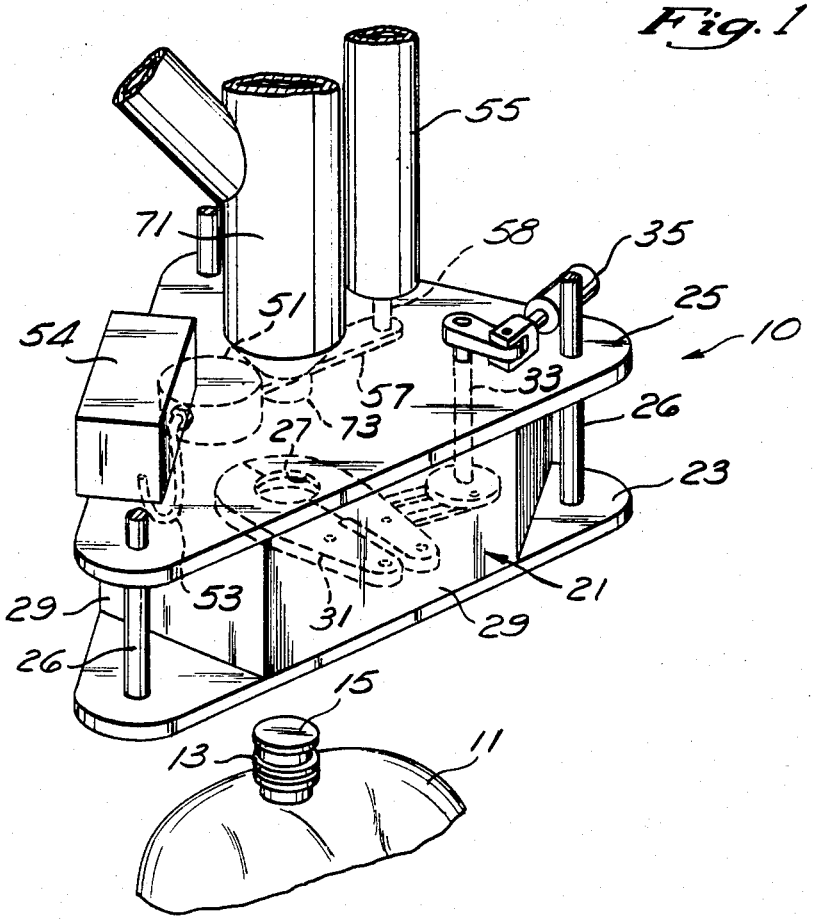
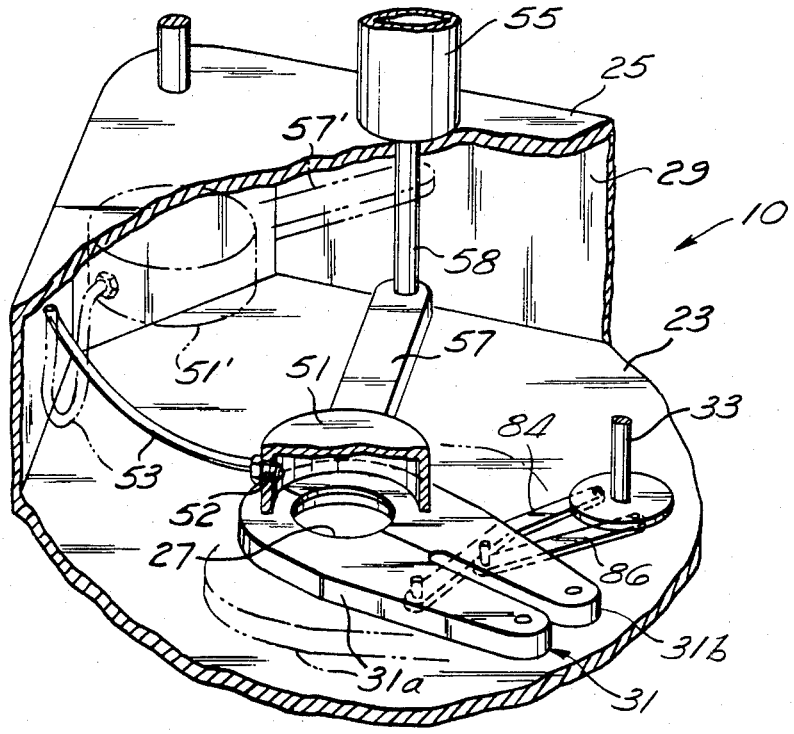
Fig. 2

Fig. 4a
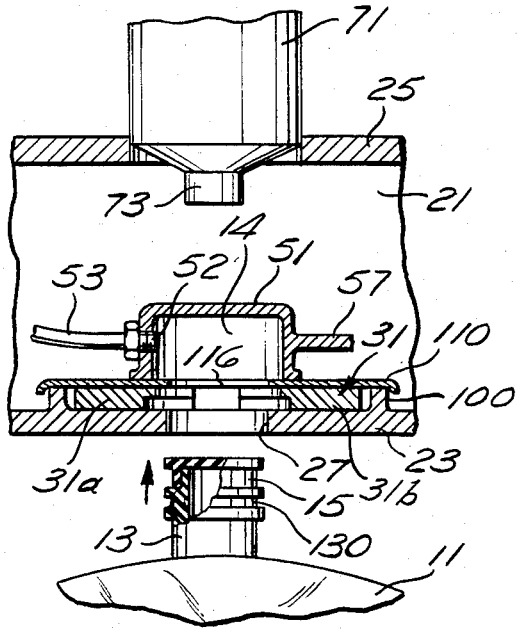
Fig. 4b
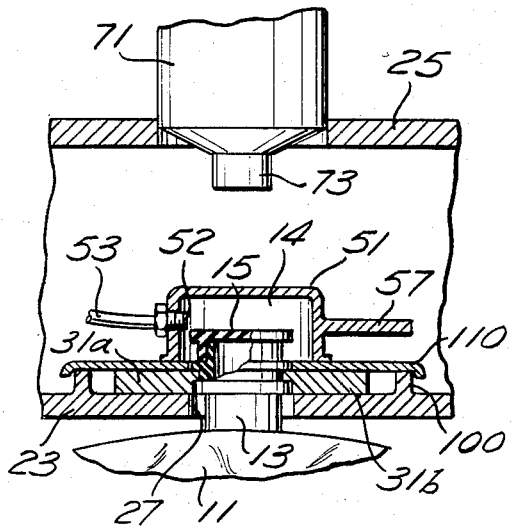
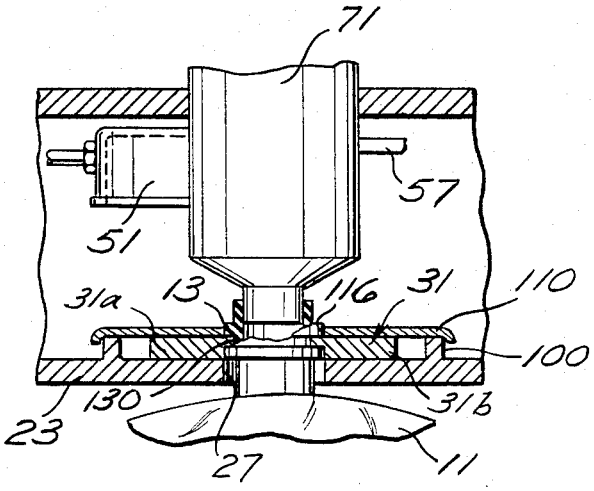
Fig. 4c

CONTAINER FILLER

BACKGROUND OF THE INVENTION

This invention relates generally to apparatus and methods for filling containers and particularly to apparatus for aseptically filling flexible containers with food products.

The present invention is an improvement over the apparatus and method of U.S. patent application Ser. No. 343,918, filed Jan. 29, 1982, entitled Apparatus and Method for Aseptically Filling a Container and assigned to the Scholle Corporation, now U.S. Pat. No. 4,458,734, issued July 10, 1984. That application describes and claims a filling apparatus including a chamber, clamping means, cup-shaped cover, use of a sterile gas and means for sterilizing the spout and cap of a container.

Many liquid and semi-liquid products are packaged into large containers for storage and distribution to repackagers, commercial users and other users of large quantities of the products. Many of these products, particularly food products, deteriorate rapidly after exposure to oxygen. Additionally, food products must be protected against possible contamination from bacteria. Therefore, these products are often placed in large bags having, for example, a five gallon capacity, made of plastic or similar flexible material and having one spout through which the bag is filled and from which the product may be dispensed from the bag. These bags are advantageous in that as the product is dispensed from the container, the bag collapses around the remaining material so that no air enters the container. With containers of a fixed shape or internal volume, air must enter the container to fill the volume left in the container as the product is dispensed. Air contains oxygen and frequently carries harmful bacteria into such containers. These containers typically have a rigid or semi-rigid plastic spout through which the product passes to enter or leave the container.

Care must be taken in packaging food products into the containers to prevent bacteria that could create a potential health risk to the consumer of the food product from entering the container. To ensure sterility, the containers are filled using a chamber that maintains a sterile atmosphere around the spout of the container. Typically, a sterile chamber is filled with a sterile gas, with the gas being maintained in the chamber at pressure greater than the ambient pressure. The pressure of the gas in the chamber ensures that very little air from outside the chamber enters the chamber, since the gas flow through any opening in the chamber walls is predominantly from the higher pressure interior to the lower pressure exterior. An opening in the bottom of the chamber receives the spout of one of the plastic bag food containers. Once the spout is placed in the opening, the spout is brought into contact with a filling head inside the chamber, and the product is dispensed into the bag.

Because of the pressure maintained in the chamber, a substantial amount of the gas may escape through the opening, particularly between filling operations after the spout of one container has been removed from the opening and before another has replaced it. Additionally, since the opening must be slightly larger than the spout of the containers, when the spout is in the opening, the gap between the spout and the rim of the opening permits the gas inside the chamber to escape to the outside environment. Because such a large amount of the sterile gas is lost in this way, a number of problems have existed. One of these problems is that only a relatively inexpensive gas can be practically used in the chamber, thereby effectively limiting the choice of gases to just one gas: hot sterile air. However, use of sterile air, which contains oxygen, exposes the food product to oxygen during the filling operation, which reduces the shelf life of the food product. Also, since the sterile gas must be kept hot to ensure continued sterility of the chamber, large volumes of the gas must be heated, which consumes a large amount of energy and requires the use of a considerable amount of equipment.

Thus, a need has existed for an apparatus for filling food containers that uses only a small amount of sterile gas, so that a gas which is inert with respect to the food products could be used as the sterile gas to increase the shelf life of the product being packaged, and to substantially reduce the heating requirements for the gas.

SUMMARY OF THE INVENTION

A container filler according to the invention has an enclosed chamber opening large enough to receive the end of a conduit, such as the spout of a flexible container, for conducting material in one side, preferably the bottom. Clamping means movable between an open position and a closed position clamps the spout in position in the opening of the chamber and holds the spout during the dispensing operation. A base plate inside the chamber covers the clamping means and has an orifice therethrough sized to admit the spout into a cup-shaped cover which seals the orifice in the base plate when the clamping means is open. The base plate with its orifice prevents substantial inflow of contaminants when clamping means is in the open position.

A hot sterile gas having a pressure greater than the ambient pressure is supplied to the chamber. The gas is preferably an inert gas, such as nitrogen, which undergoes no appreciable chemical reaction with the food product being dispensed into the spout. A material-dispensing nozzle suitable for connecting with the conduit is located in the chamber. A small cup-shaped cap may be disposed in an inverted position inside the chamber on top of the jaws to cover the orifice and substantially prevent the flow of gas through the opening.

In use, after the chamber has been sterilized and supplied with the pressurized sterile gas, the cover is placed over the orifice. Thus, virtually all of the sterile gas remains in the chamber. The spout is inserted in the clamping means and into the orifice in the base plate under the cover. The clamping means is moved into the closed position to clamp around the spout and substantially prevent the passage of any gas or air through the opening around the spout. After the spout is clamped in the opening, it is sprayed with a sterilizing fluid, such as an atomized hot liquid chlorine solution, to eliminate any bacteria that may be on it or on the inside of the cup-shaped cover. After sterilization, the cover is lifted and pivoted out of the way inside the sterile chamber. The spout ordinarily has a cap thereon which is removed by a well-known cap removing apparatus. The chamber with the spout attached thereto is moved upward while the filling nozzle is kept stationary to bring the spout into contact with the filling nozzle. The product is then dispensed through the filling nozzle and the spout into the container.

After the dispensing is complete, the chamber and the spout are lowered to the initial position; the cap is replaced on the spout; and the cover is replaced over the spout and the orifice. The clamping means is opened to permit removal of the spout from the container filler. Before the spout of an empty container is placed in the opening, the cover is placed over the orifice in the base plate to ensure that only a minimal amount of the sterile gas inside the chamber escapes to the environment.

During the entire operation, the positive pressure differential pressure of sterile gas in the chamber ensures that the chamber remains sterile and free of appreciable contamination. Should there be any leaks in the apparatus, the sterile gas will escape to the outside environment; and outside air and bacteria will be substantially prevented from entering the sterile chamber. Because the opening is substantially closed off, the loss of sterile gas is minimal.

BRIEF DESCRIPTION OF THE DRAWINGS

FIG. 1 is a perspective view of a filling apparatus;

FIG. 2 is a cut-away perspective view of the filling apparatus of FIG. 1;

FIGS. 4*a*, 4*b*, and 4*c* are cross-sectional views of the filling apparatus showing the apparatus at different stages of operation;

DESCRIPTION OF THE PREFERRED EMBODIMENT

Figure 3:
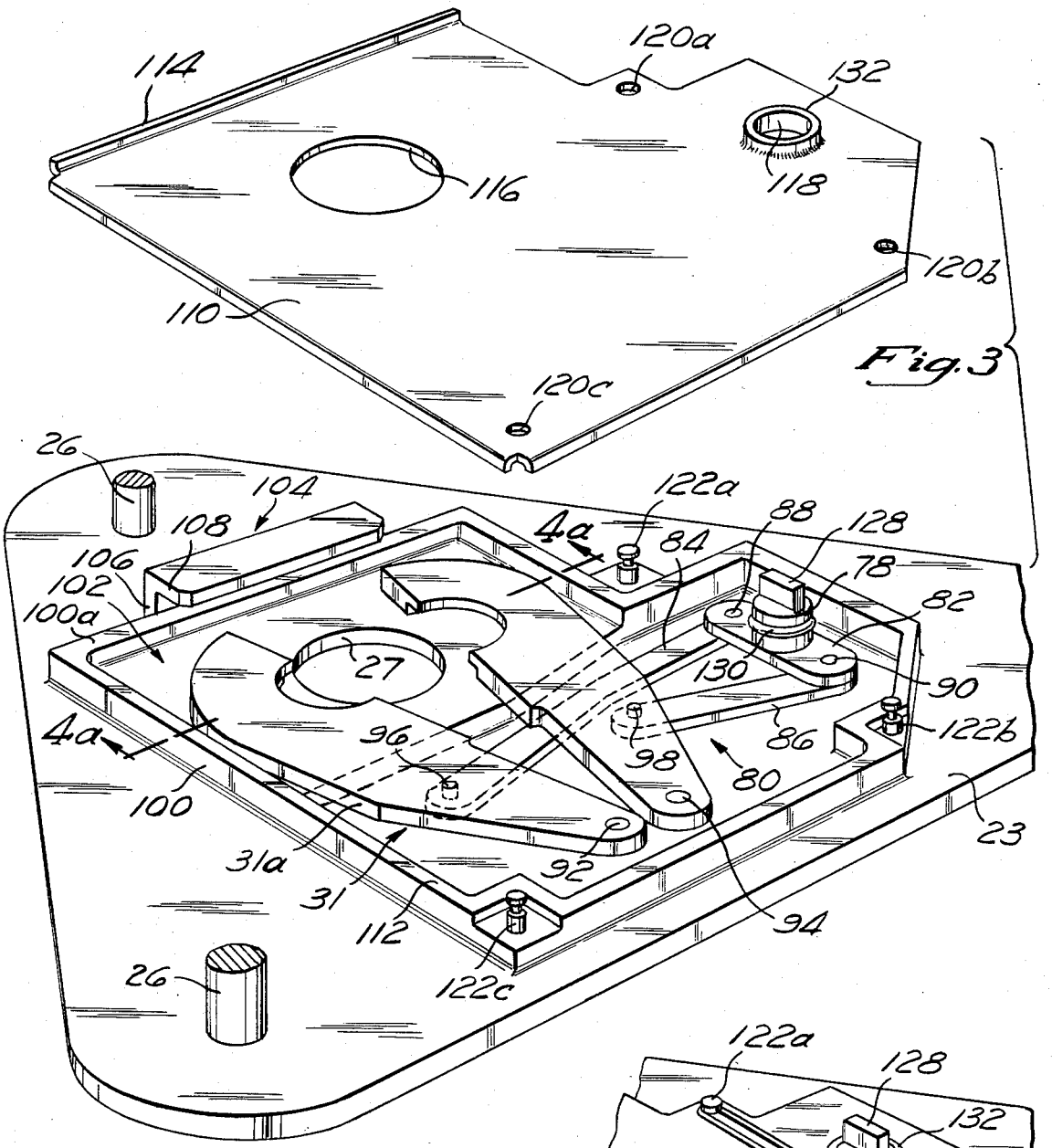
FIG. 3 is an exploded perspective view of the filling apparatus of FIGS. 1 and 2 illustrating a base plate according to the invention.

Referring to FIG. 1, a filling apparatus 10 includes a sterile chamber 21, defined by a top plate 25, a bottom plate 23, and a plurality of walls 29. A filling tube 71 passes through an opening 12 in the top plate 25 of the chamber 21. The filling tube 71 conducts a product (not shown), such as a liquid, from a source (not shown) to a nozzle 73. A filling tube that is well suited for use as the filling tube 71 is the device disclosed in U.S. Pat. No. 3,926,229, issued to William R. Scholle and assigned to the Scholle Corporation.

A container 11, which is to be filled with a product by the filling apparatus 10 of the present invention, is preferably constructed of a flexible material, such as plastic. The container 11 has a filling spout 13 which is preferably sealed by a removable cap 15. An opening 27 in the bottom plate 23 slightly larger than the spout 13 permits insertion of the spout 13 into the sterile chamber 21. The filling spout 13 of the container 11 is used hereinafter as being representative of product conduits with which the apparatus can be used.

A plurality of posts 26, which are firmly attached to the top plate 25 and the bottom plate 23, are coupled to a mechanism (not shown) for selectively raising and lowering the sterile chamber 21. The sterile chamber 21 is movable between an upper position (not shown) in which the bottom plate 23 is adjacent the nozzle 73, and a lower position in which the upper plate 25 is adjacent the nozzle 73. When the chamber 21 is moved, the filling tube 71 remains stationary while the top plate 25 slides along the outer surface of the filling tube 71 as the sterile chamber 21 is raised and lowered.

Referring to FIGS. 1 and 2, a cup-shaped cover 51 is disposed inside the sterile chamber 25 with an open end of the cover 51 facing the bottom plate 23. The cover 51 is attached to an arm 57, which pivots on a shaft 58 extending from a control mechanism 55. The cover 51 has a diameter preferably slightly larger than the diameter of the opening 27 in the bottom plate 23 of the sterile chamber 21.

A fluid line 53 connects the interior of the cup-shaped cover 51 with a source 54 of sterilizing fluid, such as a liquid chlorine solution. The source 54 controls the flow of the sterilizing fluid to selectively allow the sterilizing fluid to flow through fluid line 53 into the interior of the cover 51 to sterilize the interior thereof and the cap 15. The source 54 also preferably includes means (not shown) for heating the sterilizing fluid.

A pair of jaws 31 is pivotally connected to the bottom plate 23 of the sterile chamber 21. The jaws 31 are pivotal between a closed position as shown in FIGS. 1 and 2 and an open position as shown in FIG. 3 by rotation of a shaft 33, which is connected to a control mechanism 35. The jaws 31 are shaped to fit around the spout 13 of the container 11 in the closed position to prevent passage of fluids between the container 11 and the jaws 31. The jaws 31 open sufficiently to permit entry of spout 13 of the container 11 into the opening 27 of the bottom plate 23.

Referring to FIG. 2, the cup-shaped cover 51 is movable between two positions. In the first of these positions, indicated by the solid lines, the cover 51 is over the jaws 31 and the opening 27 in the bottom plate 21. When the cover 51 is in the first position, the interior of the cover 51 defines a small compartment 14, best shown in FIG. 4*a*, which may communicate with the outside environment through the opening 27 if the jaws 51 are open, while the remainder of the interior of the sterile chamber 21 is kept virtually isolated from the outside environment. The second position of the cup-shaped cover 51 is indicated by the phantom lines and the reference numeral 51'. In this second position, the cup 51 is removed from the vicinity of the opening 27. When the opening 27 is uncovered, there is free fluid communication between the interior of the sterile chamber 21 and the outside environment. A shaft 58 couples the control mechanism 55 to the arm 57 to govern the movement of the cover 51 between the first and second positions.

FIG. 2 also shows a nozzle 52 inside the cover 51. The nozzle 52 is suitable for spraying a hot sterilizing fluid, such as a chlorine solution, from the source 54 into the interior of the cap 51.

FIG. 3 illustrates a mechanism 80 for controlling the jaws 31. A shaft 78 extends from a rotatable control link 82. A pair of connecting links 84 and 86 are pivotally connected to opposite ends of the control link 82 and secured thereto by any suitable means such as bolts or rivets 88 and 90, respectively. The jaws 31 include a first jaw 31*a* and a second jaw 31*b* with each of the jaws 31*a* and 31*b* having an end being pivotally connected to the bottom plate 23 by any suitable means such as bolts or rivets 92 and 94, respectively. The connecting links 84 and 86 are pivotally connected by any suitable means such as bolts or rivets 96 and 98, respectively, to the jaws 31*a* and 31*b* between the opening 27 in the bottom plate 23 and the bolts 92 and 94, which pivotally connect the jaws 31*a* and 31*b* to the bottom plate 23. As viewed in FIG. 3, a clockwise rotation of the shaft 78 exerts forces on the connecting links 84 and 86 to move the jaws 31*a* and 31*b* to the closed position shown in FIG. 2; and a counter-clockwise rotation of the shaft 78 moves the jaws 31*a* and 31*b* apart to the open position of FIG. 3 so that the spout 13 of the empty container 11 may be inserted in the opening 27 and so that the spout 13 may be withdrawn from the opening 27 after the container 11 is filled.

Still referring to FIG. 3, a plurality of wall segments 100 form an enclosure 102 around the opening 27, the jaws 31*a* and 31*b*, and the jaw actuating mechanism 80. A bracket 104 extends from the bottom plate 23 proximate a wall segment 100*a*. The bracket 104 is generally L-shaped with a first leg 106 thereof being attached to the bottom plate 23 and a second leg 103 thereof being extended over and spaced apart from the wall segment 100*a*. A base plate 110 fits closely upon the upper edge 112 of the wall 100 to cover the enclosure. The base plate 110 is generally planar in configuration with one edge 114 thereof being turned slightly upward as shown in FIG. 3 away from the plane of the base plate 110. To mount the base plate 110 upon the wall 100, the upward turned edge 114 is placed between the wall segment 100*a* and the overhanging leg 108 of the bracket 104. The base plate 110 has an orifice 116 therein for alignment with the opening 27 in the bottom plate 23 and a second orifice 118 for alignment with the shaft 78. The base plate 110 additionally contains a plurality of pinholes 120*a*, 120*b*, 120*c* for alignment with a plurality of corresponding pins 122*a*, 122*b*, 122*c*. After the base plate 110 is properly aligned over the enclosure 102, the base plate 110 is pushed into contact with the walls 100 so that the shaft 78 penetrates through the opening 118 and the pins 120*a*, 120*b*, 120*c* penetrate through the corresponding pinholes 122*a*, 122*b*, 122*c*.

Figure 5:
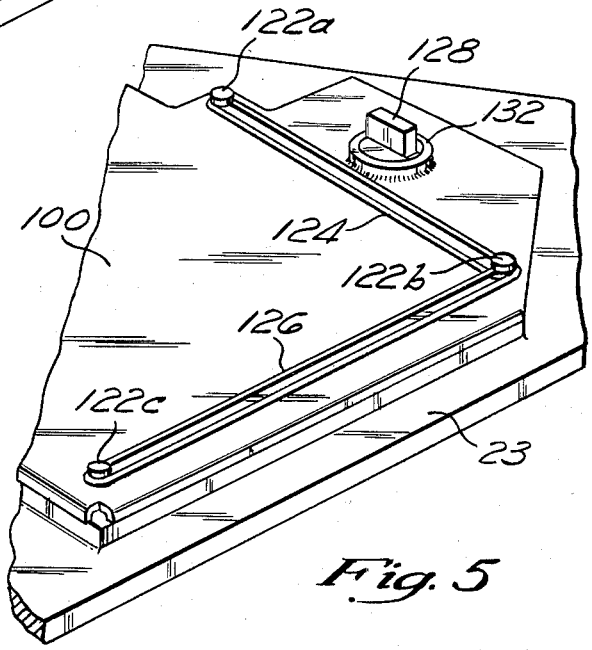
FIG. 5 is a partial perspective view showing the base plate of FIG. 3 positioned in the filling apparatus of FIGS. 1 and 2.

Referring to FIG. 5, a pair of elastomeric bands 124 and 126 stretched between the pins 122*a*, 122*b*, and 122*b*, 122*c*, respectively, retain the base plate 110 in position upon the wall 100. Thus, the base plate 110 may be easily removed for cleaning and servicing apparatus within the enclosure 102.

Referring again to FIG. 3, a key 128 extends from the shaft 78 outwardly from the base plate 110 when the base plate 110 is in position on the walls 100 and over the shaft 78. A seal, such as an elastomeric ring 130, is mounted to the shaft 78 to form a fluid-tight seal with a ring 132 which extends outwardly from the base plate 110. The key 128 provides convenient means for connecting the shaft 78 to a second shaft such as the shaft 33 of FIG. 1 for connection to the control mechanism 35 which controls rotation of the control link 82.

The orifice 116 in the base plate 110 is placed over the jaws 31*a* and 31*b* in alignment with the opening 27 to limit the amount of sterile gas which might escape from the sterile chamber 21 and to control fluid communication between the sterile chamber 21 and the external environment to limit the amount of air and bacteria from the external environment which could enter through the opening 27 and the jaws 31 into the sterile chamber 21 when the jaws 31*a* and 31*b* are in the open position, as shown in FIGS. 3 and 4*a*. The orifice 116 in the base plate 110 is preferably just large enough to permit insertion of the spout 15 therethrough.

FIG. 4*a* illustrates the jaws 31*a* and 31*b* in the open position with the cover 51 being positioned over the opening 116 in the base plate 110. The sterile chamber 21 is in its lower position to place the nozzle 73 a sufficient distance from the base plate so that the cover 51 may be properly positioned over the orifice 116 to prevent the escape of sterile gas from the sterile chamber 21. The spout 15 is illustrated as being moved toward the opening 27 in the bottom plate 23.

Referring to FIG. 4*b*, the spout 15 is in position for filling with the cover 51 still being in position over the opening 116 in the base plate 110 so that a sterilizing fluid may be sprayed through the nozzle 52 to sterilize the enclosure within the cover 51 and to sterilize the portion of the spout 15 inside the enclosure.

Referring to FIG. 4*c*, the cover 51 has been removed from the base plate 110 and the sterile chamber 21 has been elevated so that the nozzle 73 is inserted in the spout 15 for filling the container 11. In both FIGS. 4*b* and 4*c*, the jaws 31 are closed around the spout 15, which has a groove 130 therein for engagement with the jaws 31.

Figure 6:
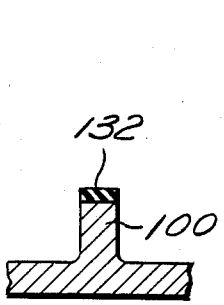
FIG. 6 is a cross-sectional view showing a seal for mounting the base plate of FIG. 4 in the filling apparatus of FIGS. 1 and 2.
Figure 7:
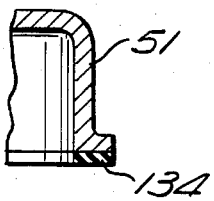
FIG. 7 is a cross-sectional view showing a seal for a cover used with the base plate of FIG. 4.

In most applications, the base plate 110 fits upon the upper edge 112 of the wall 100 to form an adequate seal to control fluid communication between the sterile chamber 21 and the external environment. However, referring to FIG. 6, the wall 100 may have an upper edge 132 formed of any suitable elastomeric sealing material. Referring to FIG. 7, the cover 51 may have a rim 134 formed of an elastomeric material to seal the cover 51 on the base plate 110 around the orifice 116.

OPERATION OF THE APPARATUS

The container filler 10 is shown in its initial state in FIG. 4*a*. The cap 51 is in its first position, resting on the base plate 110 which covers the jaws 31, which are in their open position. The small compartment 14 under the cap 51 is open to the outside environment through opening 27, but the cap 51 seals the remainder of the sterile chamber 21 from the outside environment. The sterile chamber 21 is in its lower position, with the upper plate 25 adjacent the nozzle 73. The interior of the sterile chamber 21, except for the compartment under the cap 51, is supplied with a sterile gas at a pressure slightly above atmospheric pressure. In order to maximize the shelf life of the product being packaged into the container 11, this gas is preferably a gas that contains no oxygen and is ideally an inert gas such as nitrogen. The gas is supplied to the sterile chamber 21 in a sufficient quantity that the gas pressure inside chamber 21 remains greater than the ambient pressure. The positive pressure differential ensures that if there are any leaks in the container filler 10, some of the gas from inside the sterile chamber 21 will escape to the outside environment. The outflow of gas from the sterile chamber 21 preserves the sterility of the sterile chamber 21 by restricting the flow of outside air with the bacteria it may contain, into the sterile chamber 21.

The container 11, such as a flexible plastic bag, and the spout 13, have previously been sterilized and sealed with the cap 15, which prevents air and bacteria from entering the container 11.

The container 11 is brought near the bottom plate 23 of the sterile chamber 21, and the spout 13 is inserted through the opening 27, the open jaws 31 and the orifice 116 into the compartment 14 enclosed by the cover 51. Any contamination that is on the spout 13 when it is placed in the opening 27 does not enter the sterile chamber 21 because the cover 51 covers the compartment 14. The jaws 31 are then closed around the spout 13, as shown in FIG. 4*b*. The jaws 31 hold the spout 13 in place in the opening 27 and also effectively prevent the flow of any gas between the compartment 14 under the cup-shaped cover 51 and the outside environment. As shown in FIG. 4*b*, the spout 13 projects into the compartment 14 beyond the base plate 110. A sterilizing fluid, such as a solution of chlorine from the source 54 (FIG. 1), is directed through the fluid line 53 and sprayed through the nozzle 52 into the interior of the compartment 14 under cover 51. The fluid sterilizes the interior of the compartment 14 under the cover 51 and also sterilizes the exterior of the container spout 13 and the container cap 15.

After the container spout 13 and the container cap 15 have been sterilized, the cover 51 is moved up and away from the base plate 110 to a position substantially as shown in FIG. 1, thus unifying the sterile chamber 21. Since the interior of the compartment 14 and the spout 13 have been sterilized; and the jaws 31 are closed around spout 13, no contaminants enter the sterile chamber 21 when the cover 51 is moved away from the base plate 110. The cap 15 of the container 11 is removed from the spout 13 so that fluid communication is established between the interior of sterile chamber 21 and the interior of the sterile container 11. Mechanical means for removing the cap 15 from spout 13 are well known in the food packaging industry, and inclusion of such means would unduly complicate the drawings; therefore, the mechanism for removing the cap 15 from the spout 13 is not shown. The jaws 31, which are closed around the spout 13, seal the sterile chamber 21 from the outside environment while the container 11 is being filled. Nevertheless, the positive pressure differential of gas in the sterile chamber 21 ensures that any leaks therein will result in sterile gas leaving the sterile chamber 21, minimizing entry of outside air and the bacteria it may carry into the sterile chamber 21. It has also been found that moisture resulting from spraying the sterile fluid into the compartment 14 enters between the base plate 110 and the wall 100 by capillary action to form a seal. Similar sealing results between the cover 51 and the base plate 110.

The sterile chamber 21 is then moved upward, sliding along the outside of the filling tube 71, until the nozzle 73 of the filling tube 71 enters the spout 13 of the container 11, as shown in FIG. 4*c*. The product with which container 11 is to be filled is dispensed from filling tube 71, through the nozzle 73 and the spout 13, and into the container 11.

After the container 11 has been filled, the sterile chamber 21 is lowered again to its initial position and the container cap 15 is again placed on the spout 13 to seal the container 11. The cover 51 is again placed on the base plate 110 to form the small compartment 14 over the spout 13 as shown in FIG. 4*b*. Because the cover 51 is in place over the opening 44 when the jaws 31 are opened, essentially no contamination from outside enters the sterile chamber 21. After the jaws 31 are opened, the spout 13 is removed from the opening 27. The filling apparatus 10 is then ready to receive another container 11.

During the entire operation, sterility of the sterile chamber 21 is ensured by the positive pressure differential of sterile gas maintained between the interior and exterior of the chamber 21. Any leaks in the sterile chamber 21 will result in an outflow of gas, rather than any appreciable inflow of outside air and bacteria. Nevertheless, since the opening 27 is sealed during the entire operation of the apparatus, either by the base plate 110 and the cover 51, which allow only a small compartment of the sterile chamber 21 to be in fluid communication with the outside environment through the opening 27, or by the jaws 31 being closed around the spout 13 to prevent virtually all fluid communication between the interior of the sterile chamber 21 and the outside environment. Thus, only a small amount of the sterile gas escapes from the sterile chamber 21 during the operation of the filling apparatus 10.

What is claimed is:

1. A container filler for aseptically filling a container with a product, comprising:

an enclosed chamber having a wall opening therein for communication with the outside environment, means for supplying said chamber with a fluid at a positive pressure with respect to the outside environment and means for conducting said product into said chamber;

clamping means adjacent said opening movable between an open position for permitting insertion of a filling spout extending from the container into said enclosed chamber before filling and for permitting withdrawal of the filling spout from said enclosed chamber after filling and a closed position for engaging the spout to form a seal against fluid communication between said enclosed chamber and the outside environment while the container is being filled; and means for substantially enclosing said clamping means to limit fluid communication between said enclosed chamber and the outside environment when said clamping means is in the open position.

2. A container filler according to claim 1 wherein said clamping means is inside said chamber and said enclosing means comprises:

a wall portion inside said enclosed chamber around said clamping means; and a base plate mounted upon said wall portion, said base plate having an orifice therethrough in alignment with said wall opening.

3. A container filler according to claim 2 wherein said clamping means includes a set of jaws comprising a first jaw and a second jaw, said first jaw and said second jaw being pivotally mounted within said enclosed chamber, further comprising:

a first connecting link pivotally connected to said first jaw;

a second connecting link pivotally connected to said second jaw;

a control link pivotally connected to said first and second connecting links;

a shaft extending from said control link, said base plate having a second orifice therethrough, said shaft extending through said second orifice sealingly engaged with said base plate; and means connected to said shaft for rotating said shaft to move said first jaw and said second jaw between the closed position for clamping the spout and an open position for permitting movement of the spout within said wall opening.

4. A container filler according to claim 2 further comprising a cover for placement over said orifice when said clamping means is in the open position to seal said enclosed chamber against fluid communication with the outside environment.

5. A container filler according to claim 2 wherein said base plate sealingly engages said wall portion to control fluid communication between said enclosed chamber and the outside environment.

6. A container filler according to claim 2 further comprising: means for selectively covering said orifice in said base plate to control fluid communication therethrough.

7. A container filler according to claim 6 wherein said covering means comprises:

a cup-shaped cover; and means for controlling the position of said cup-shaped cover to seal said orifice in said base plate when said clamping means is in the open position and to permit insertion of a filling tube into the spout for filling the container when said clamping means is in the closed position.

8. A container filler according to claim 5 further including a bracket mounted within said enclosed chamber adjacent said wall portion for engaging an edge of said base plate to retain said base plate in engagement with said wall portion.

9. A container filler according to claim 8 wherein said wall portion includes elastometric sealing means thereon for sealing engagement with said base plate.

10. A container filler according to claim 9 further including:

means for supplying a sterile fluid to the interior of said enclosed chamber; and means for supplying a sterile fluid to said spout when said cover is positioned over said orifice.

11. A method of aseptically filling a container with a product using filling apparatus in a sterile chamber, comprising the steps of:

providing an enclosed sterile chamber having a wall opening therein and supplying said chamber with a fluid at a positive pressure with respect to the outside environment;

placing a spout of a container to be filled in the opening;

clamping the spout with clamping means within the opening to seal the opening to control fluid communication between the enclosed chamber and the outside environment around the spout, said clamping means being substantially enclosed to limit fluid communication between said enclosed chamber and the outside environment when said clamping means is in an open position.

* * * * *